US006283907B1

(12) United States Patent
Shea

(10) Patent No.: US 6,283,907 B1
(45) **Date of Patent: *Sep. 4, 2001**

(54) METHOD AND ASSOCIATED APPARATUS FOR IMPARTING A HELICAL CURL TO RIBBON MATERIAL FOR MAKING A DECORATIVE ELEMENT

(75) Inventor: Scott Shea, Berwick, PA (US)

(73) Assignee: Berwick Delaware, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/079,603

(22) Filed: May 15, 1998

(51) Int. Cl.[7] ..... B31B 1/36
(52) U.S. Cl. ..... 493/459; 493/346; 493/955
(58) Field of Search ..... 493/343, 344, 493/345, 346, 459, 461, 462, 470, 341, 383, 384, 385, 944, 955; 53/113, 127, 440, 447, 580; 206/495; 28/289, 290, 291

(56) References Cited

U.S. PATENT DOCUMENTS

| | | |
|---|---|---|
| 1,652,855 | 12/1927 | Fernandez . |
| 1,773,580 | 8/1930 | Franke . |
| 2,226,181 | 12/1940 | Ridderstron . |
| 2,384,462 | 9/1945 | Goodman . |
| 2,393,058 | 1/1946 | Pierce et al. . |
| 2,649,393 | 8/1953 | Cumming . |
| 2,669,913 | 2/1954 | Cerone . |
| 2,880,540 | 4/1959 | Williams . |
| 3,143,456 | 8/1964 | McGrath et al. . |
| 3,159,873 | 12/1964 | Mylo et al. . |
| 3,256,129 | 6/1966 | Wallerstein et al. . |
| 3,327,915 | 6/1967 | Lubin . |

(List continued on next page.)

FOREIGN PATENT DOCUMENTS

| | | |
|---|---|---|
| 3421175 | 12/1985 | (DE) . |
| WO9111617 | 10/1991 | (WO) . |

*Primary Examiner*—Peter Vo
*Assistant Examiner*—Louis K. Huynh
(74) *Attorney, Agent, or Firm*—Seidel, Gonda, Lavorgna & Monaco, PC

(57) ABSTRACT

This invention provides a method and associated apparatus in which decorative ribbons of varying thickness, width, and material can be automatically produced, curled, grouped, and combined in a decorative element which is packaged for distribution. The apparatus serves to impart a helical curl to at least one of a plurality of ribbon strands, meters the strands into preselected lengths, separates the lengths from the ribbon stock, and packages the resulting coiled ribbon arrangements for distribution to customers. The apparatus includes one or more roll stands for storing rolls of ribbon stock, a feed unit for advancing the ribbon through the apparatus and imparting a tendency to curl the strands, a tension regulator unit for accumulating metered lengths of the stands and regulating the advancement of the ribbon strands through the apparatus, and a packaging unit for attaching the ribbon on a placard, to form a decorative element having a cluster of curled ribbon strands.

4 Claims, 5 Drawing Sheets

U.S. PATENT DOCUMENTS

| | | | | |
|---|---|---|---|---|
| 3,396,880 | | 8/1968 | Lopata . | |
| 3,575,289 | | 4/1971 | Brousse . | |
| 3,591,434 | | 7/1971 | Hartstein . | |
| 3,637,452 | | 1/1972 | Sanders . | |
| 3,681,912 | * | 8/1972 | Silverman | 57/284 |
| 3,832,841 | | 9/1974 | Cole . | |
| 3,962,957 | | 6/1976 | Hinzmann . | |
| 3,996,842 | | 12/1976 | Ehlich et al. . | |
| 4,025,878 | | 5/1977 | Predmore . | |
| 4,044,501 | | 8/1977 | Frydryk . | |
| 4,080,242 | | 3/1978 | Komenda . | |
| 4,138,048 | | 2/1979 | Lemmon . | |
| 4,138,049 | | 2/1979 | McAlarney . | |
| 4,182,738 | | 1/1980 | Casaert et al. . | |
| 4,201,806 | | 5/1980 | Cole . | |
| 4,281,854 | | 8/1981 | Savich . | |
| 4,324,827 | | 4/1982 | Obayashi et al. . | |
| 4,388,264 | | 6/1983 | Leuvelink . | |
| 4,449,652 | | 5/1984 | Coppins et al. . | |
| 4,528,833 | | 7/1985 | Inaike et al. . | |
| 4,532,169 | | 7/1985 | Carley . | |
| 4,681,723 | | 7/1987 | Jester . | |
| 4,713,267 | | 12/1987 | Truskolaski . | |
| 4,721,122 | | 1/1988 | Sahm . | |
| 4,798,754 | | 1/1989 | Tomek . | |
| 4,851,275 | | 7/1989 | Yes . | |
| 4,884,583 | | 12/1989 | Long, Jr. . | |
| 4,884,826 | | 12/1989 | Slagsvol . | |
| 4,915,996 | | 4/1990 | Curry . | |
| 4,919,980 | | 4/1990 | Pirkey . | |
| 4,952,281 | | 8/1990 | Akira . | |
| 4,968,540 | | 11/1990 | Linsenbigler . | |
| 4,980,942 | | 1/1991 | Spargo, Sr. . | |
| 5,004,144 | | 4/1991 | Selga . | |
| 5,036,590 | | 8/1991 | Reinke et al. . | |
| 5,072,865 | * | 12/1991 | Lyons | 493/955 |
| 5,120,296 | | 6/1992 | Yamaguchi et al. . | |
| 5,122,211 | | 6/1992 | Roach . | |
| 5,154,688 | | 10/1992 | Boyd . | |
| 5,156,893 | | 10/1992 | Barthe . | |
| 5,232,132 | | 8/1993 | Broussard et al. . | |
| 5,257,492 | | 11/1993 | Watts . | |
| 5,261,578 | | 11/1993 | Monahan . | |
| 5,297,705 | | 3/1994 | Schmidt . | |
| 5,316,539 | | 5/1994 | Leemhuis et al. . | |
| 5,383,837 | | 1/1995 | Watts . | |
| 5,395,469 | | 3/1995 | Suggs, Jr. et al. . | |
| 5,400,452 | | 3/1995 | Goldstein . | |
| 5,407,417 | | 4/1995 | Goldstein . | |
| 5,411,774 | | 5/1995 | Weder . | |
| 5,470,620 | | 11/1995 | Weder . | |
| 5,518,492 | | 5/1996 | Goldstein . | |
| 5,711,752 | | 1/1998 | Goldstein . | |

* cited by examiner

METHOD AND ASSOCIATED APPARATUS FOR IMPARTING A HELICAL CURL TO RIBBON MATERIAL FOR MAKING A DECORATIVE ELEMENT

FIELD OF THE INVENTION

The present invention relates to the automated manufacture of decorative elements for the adornment of packages and the like, and more particularly to a novel method of imparting a curl to one or more ribbon strands for incorporation in the decorative elements.

BACKGROUND OF THE INVENTION

Decorative elements such as ribbons and bows are commonly affixed to packages, gifts, and the like. Often times, these decorative elements serve as a reminder of a particular holiday, event, or simply serve as a personal expression of one's thoughtfulness. Indeed, a carefully packaged, decorative gift wrapping is increasingly recognized as a desirable component of any personal, family, or holiday celebration. As such, the degree of perceived originality or creativity in the design of such packaging ornaments is a key component of the commercial appeal of these items to the buying public.

In response to consumer demand for increased selection and originality in ribbon designs, manufacturers have introduced hand-made ribbon arrangements. These arrangements are multicolored ribbons of varying width, thickness, patterns, and colors which are hand wound, packaged, and sold individually. The ribbon arrangement is processed by hand to impart a curl to the material, resulting in a pleasing combination of grouped sections of multicolored helically coiled ribbons. Typically, the curl in a flat ribbon is created by running the length of the ribbon materials across a sharp edge.

The hand-made ribbons are packaged by attaching the ribbon arrangement to a cardboard placard for positioning on a retail display. Upon purchase, the ribbon is detached from the packaging and affixed to a gift box by way of an adhesive included on the underside of the ribbon arrangement or placard, typically double face tape.

Yet, while aesthetically appealing, hand made ribbons are cost prohibitive for many consumers. Consumers have grown accustomed to machine produced ribbons which are less expensive due to the lack of manual labor required for their creation. Heretofore, attempts at automating the curling process have been frustrated by the varying materials, widths, and thicknesses commonly encountered in the most desirable hand-made ribbons.

Therefore, currently a method and associated apparatus is desired in which decorative ribbons of varying thickness, width, and material can be produced, curled, grouped, and packaged for sale automatically and cost effectively.

SUMMARY OF THE INVENTION

A method and associated apparatus in which decorative ribbons of varying thickness, width, and material can be automatically produced, curled, grouped, and packaged for sale is provided. The apparatus includes one or more roll stands, a feed unit, a tension regulator unit, and a packaging unit. The apparatus imparts a helical curl to at least one of a plurality of ribbon strands, measures the strands into preselected lengths, separates the lengths from the ribbon stock, and packages the resulting coiled ribbon arrangements for distribution to customers.

The method of imparting the curl to the ribbon is accomplished through the application of controlled temperature to a ribbon strand advancing along an apparatus travel path. The ribbon is wound around a mandrel or curl tube as a helix and is heated to a predetermined temperature and cooled along the ribbon travel path to impart a curling tendency to the ribbon strand. The ribbon travel path spirals about the periphery of hollow threaded curl tubes such that apertures formed therein exhaust temperature-controlled air for imparting and setting a curl to the ribbon traveling around the tube.

The roll stand of the apparatus provides ribbon stock for supplying the apparatus with a plurality of ribbon materials of varying dimension, styles, and colors. The ribbon is drawn off from the free spooling roll stand by the feed unit.

The feed unit draws the ribbon strands from the roll stand. Drive rollers of the feed unit frictionally engage the ribbon strands drawing them into the feed unit. The ribbon strands are drawn from the roll stand, and are fed by the drive rollers of the feed unit to a corresponding one of the curl tubes of the feed unit. The curl tubes put a helical curl in the ribbon strands, and temperature-controlled air is provided for setting the curl in the ribbon strands. The ribbon strands exit the feed unit passing to the tension unit.

The tension regulator unit is provided to regulate the tension in the exiting ribbon strands and control rotation of the drive rollers of the feed unit. At its exit end, the tension regulator unit stacks multiple strands of the flat ribbon in face-to-face contact, and passes a group of ribbon strands to the packaging unit in a single vertical stack.

The packaging unit clamps, automatically arranges, and secures the curled ribbon strands onto a placard for distribution to customers, dropping the packaged ribbon product to a conveyor belt for shipping.

Still other benefits and advantages of this invention will become apparent to those skilled in the art upon a reading and understanding of the following detailed specification and related drawings.

BRIEF DESCRIPTION OF THE DRAWINGS

The foregoing summary, and the following detailed description, will be best understood when read in conjunction with the attached figures, in which.

DESCRIPTION OF THE PREFERRED EMBODIMENT

Figure 1:
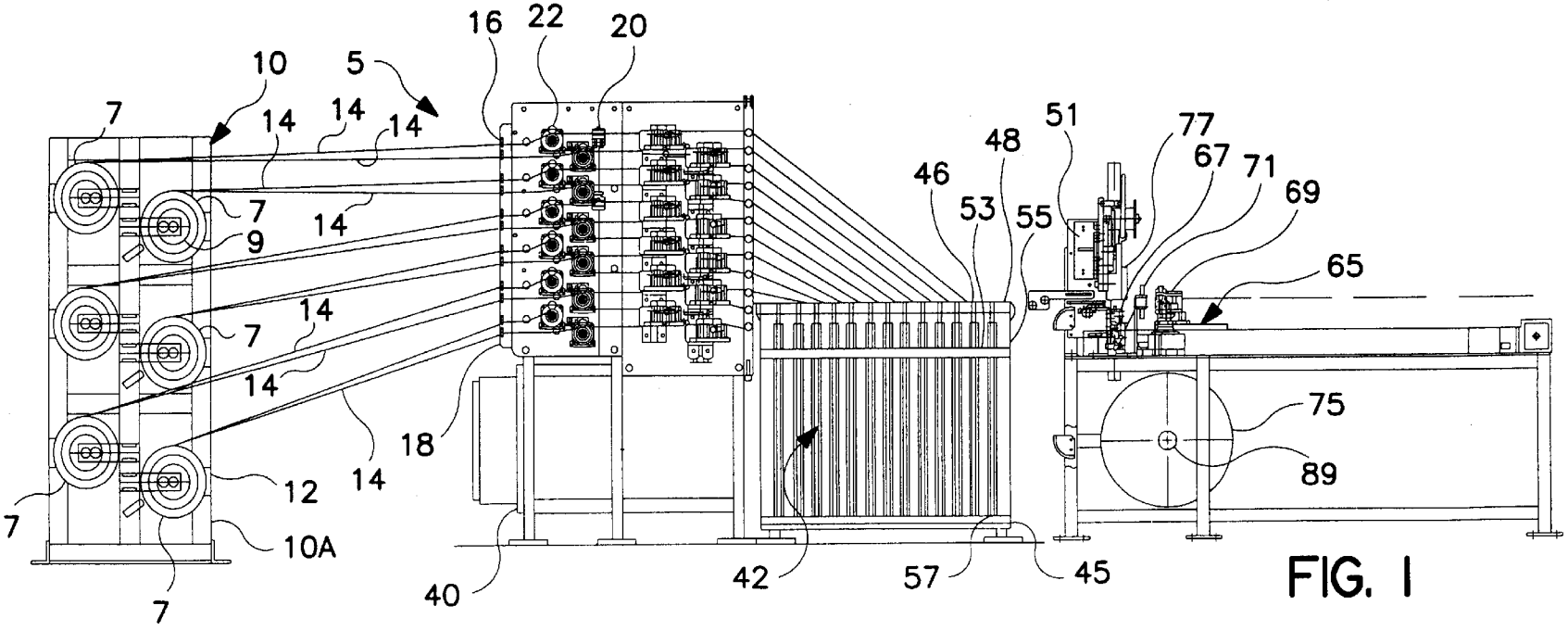
FIG. 1 is a side view of the apparatus of the present invention.
Figure 2:
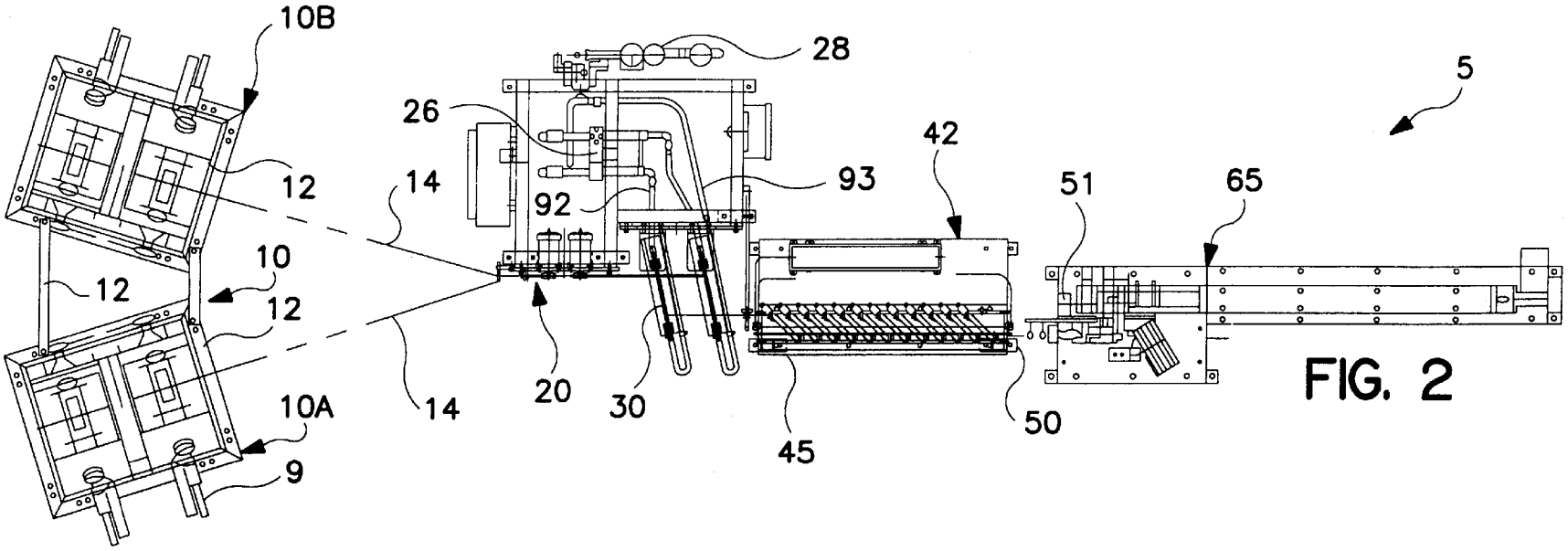
FIG. 2 is a top view of the apparatus illustrated in FIG. 1.
Figure 3:
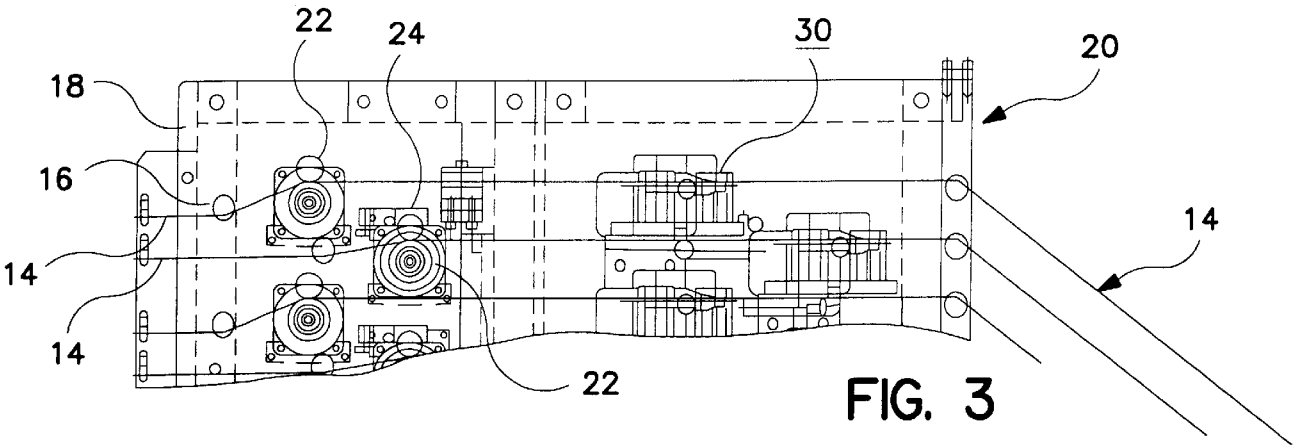
FIG. 3 is an enlarged fragmentary view of the apparatus illustrated in FIG. 1, showing the ribbon feed-drive in the feed unit for the uppermost strands of ribbon.

Referring to FIGS. 1 and 2, the apparatus is shown at 5 and comprises a ribbon supply station 10 which mounts a plurality of ribbon spools 7 containing strands of ribbon 14 for feeding to a feed unit 20.

The feed unit 20 constitutes a curling apparatus having drive rollers 22 for withdrawing strands of ribbon from the supply and advancing each strand to a curling tube 30. The ribbon is wrapped around the curling tube 30 in a helical path 38 having two parts. In the first part, the strand of ribbon is heated while in the helical configuration and in the second part, the strand is cooled while in the same helical configuration, the heating and cooling of the ribbon strand imparting a tendency for the strand to curl.

From the curling tubes of the curling apparatus 20, the strands are fed to a tension regulator apparatus 42 which receives and accumulates a metered length of each strand discharged from the curling apparatus. Sufficient tension is applied to each strand in the tension regulator to resist the tendency of the strand to curl so that it travels through the tension regulator unit 42 without curling. At the discharge end of the tension regulator unit 42, the strands are stacked in face-to-face confronting relation at the feed end of a packaging unit 65.

The packaging unit 65 with a gripper 69 withdraws a predetermined length of the ribbons in the stack in two steps. At the end of the first step, a placard is fed into registry with the stack at the feed end of the unit 65 and the stack of ribbons 14 are attached to a placard. After the attachment of the stack of ribbons to the placard, the second step of the withdrawal carries the placard away from the feed end of the packaging unit so that the placard is attached to a midpoint of the predetermined length of the stack extending from the gripper 69 to the feed end of the packaging unit 65. Thus, the stack of ribbons attached to the placard are severed from the ribbons emanating from the tension regulator unit, and the gripper is released to allow the individual strands attached to the placard to curl up and form a decorative element. The placard with the curled ribbon strands attached thereto is incorporated in a package for distribution to customers.

As shown in FIG. 1, the ribbon supply station 10 comprises a pair of roll stands 10A and 10B in the form of a creel having a plurality of spindles 9 mounting individual spools 7 of flat ribbon. The roll stands 10A and 10B are angularly positioned on a frame 12 so as to provide unimpeded travel of the strands 14 to the feed unit 20 without tangling or chafing. Each ribbon strand 14 from the ribbon supply station 10 is threaded through the feed unit or curling apparatus 20.

As shown in FIGS. 1–4, the feed unit 20 has a pair of drive or feed rollers 22 for each of the strands 14. The drive rollers have a nip engaging the flat ribbon to withdraw the strand 14 from the supply station 10 and feed it to a curl tube 30. The feed rollers 22 are mounted on a rack 18 having guide posts 16 for directing the ribbon strands into the nip of the feed rollers. The guide posts 16 serve to separate the ribbon strands 14 and direct them to the feed rollers 22 without chafing or tangling. The feed rollers 22 are elastomeric so as to provide a firm grip of the ribbon as it passes into the nip therebetween. The number of feed roller sets 22 corresponds to the number of ribbon strands 14 so that each ribbon strand is positively fed from the ribbon supply to a curl tube. The feed rollers 22 are individually controlled by control circuits 24 under the control of the tension regulator 42, as described more fully hereinafter in connection with FIGS. 3 and 4.

Figure 4:
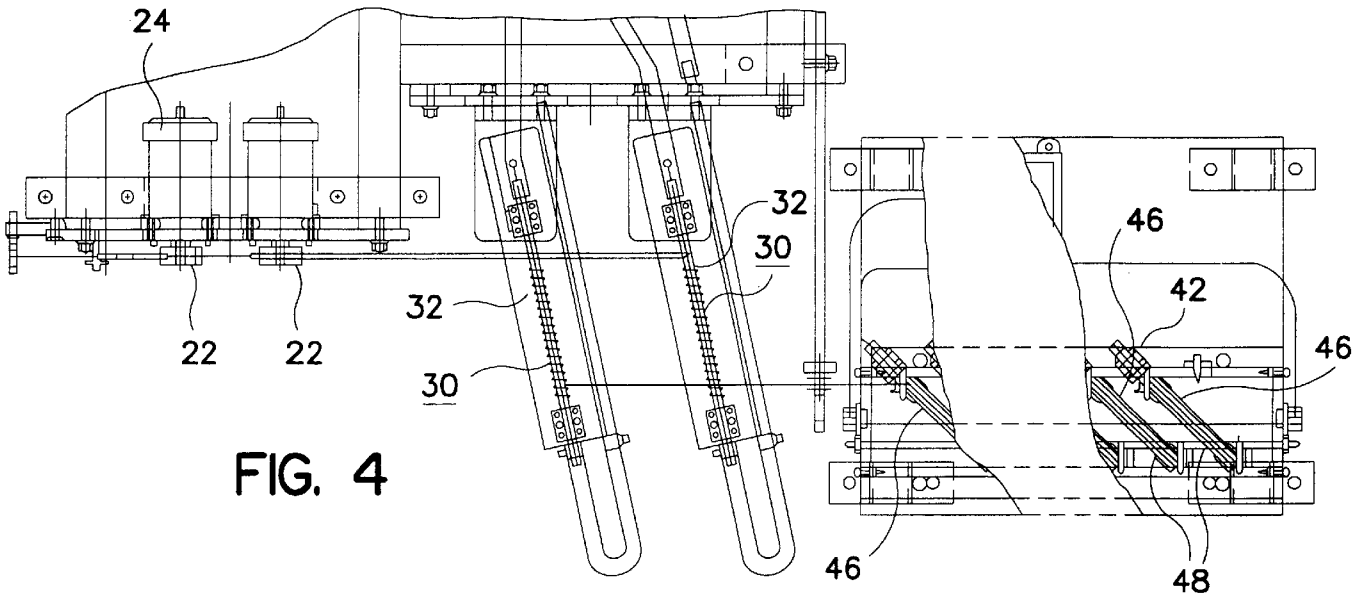
FIG. 4 is a fragmentary plan view of the apparatus illustrated in FIG. 3.

From the feed rollers 22, the ribbon strands are fed to curl tubes 30 having a fin 32 forming a helical guide path, such as a groove or channel 38 (see FIG. 5) around the external cylindrical periphery of the curl tube. As shown in FIG. 4, the curl tubes 30 are arranged in pairs, one of the tubes having a clockwise-wound fin 32 and the other having a counterclockwise-wound fin. The ribbon is directed onto the clockwise-wound tube over the top as shown in FIG. 4 and to the counterclockwise-wound tube to the underside. The helical curls set in the strands by the two tubes are of opposite hand, so as to cause their separation in the decorative element when activated in the packaging unit. Each ribbon strand is threaded within the guide path 38 (see FIG. 5) in contact with the outer cylindrical surface of the tube 30. After traveling the length of the helical path 38 formed between the fins 32, the ribbon strand is withdrawn into the tension regulator unit 42.

Preferably, the spacing between the fins 32 corresponds to the width of the widest strand of ribbon which is to be fed through the helical guide path 38. The maximum spacing of the fins will accommodate ribbons of any width up to the maximum. Inasmuch as the feed and curling unit accommodates 12 ribbon strands, if the supply of ribbons requires that the unit handle a predetermined arrangement of widths, the spacing between the fins may be accommodated to the individual widths of the ribbons. The ribbons have at least one flat face to ride on the cylindrical exterior surface of the curl tube 30 so as to maximize the heat transfer between the traveling ribbon and the curl tube.

When the ribbon travels in the helical path wrapped around the tube 30, it is subjected to first heating and then cooling, so as to create a tendency for the ribbon to curl into a helix conforming to the path. In the present instance, the heating and cooling of the ribbon strand is accomplished through the application of temperature-controlled air to the strand as it is advanced through the ribbon path 38.

Figure 5:
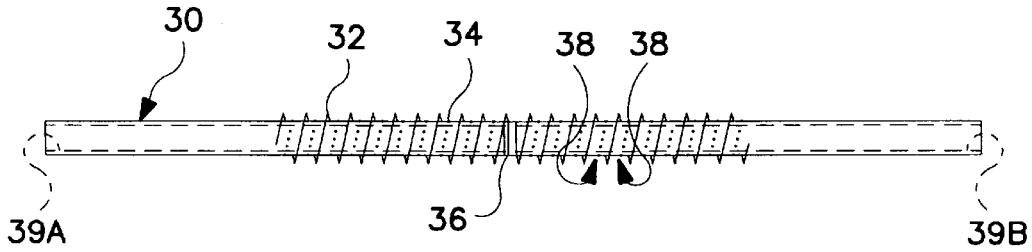
FIG. 5 is an enlarged side view of a curling tube of the feed and curling unit of the apparatus illustrated in FIG. 1.

As shown in FIG. 5, the curling tube 30 is hollow and has a central plug 36 dividing the hollow interior of the tube into a lefthand and righthand chamber designated 39A and 39B respectively in FIG. 5. The tube is provided with apertures 34 between the fins 32 affording fluid communication between the hollow bores 39A and 39B with the helical path 38 defined between the fins 32. The plug 36 divides the helical path 38 into a first part overlying the bore 39A and a second part overlying the bore 39B. The bores 39A and 39B are supplied with temperature-controlled air by feed tubes 92 from an air heater 26 which directs heating air into the bore segments 39A of the plurality of curling tubes 30 in the feed and curling unit 20. Cooling air is supplied to the other end of the curling tubes in the bores 39B through feed tubes 93 so as to exhaust cooling air through the apertures 34 in the second part of the helical path. Thus, as the ribbon is advanced in the helical path around the cylindrical circumference of the tube, the ribbon is first subjected to heating by the heating air exhausted from the bore 39A and then is subjected to cooling air exhausted from the bore 39B, the flat ribbon being wrapped with its face in engagement with the cylindrical surface of the tube so as to assume a helical configuration. In the first part of the helical path, the ribbon strands are heated to a sufficiently high temperature to allow the ribbon to assume a helical set without destruction of the continuity of the ribbon. The helical set is fixed in the ribbon by the passage through the cooling part of the path 38. Air is supplied to the tube 93 and the heater 26 and tube 92 through an air supply having suitable filters as indicated at 28 in FIG. 2.

Figure 6:
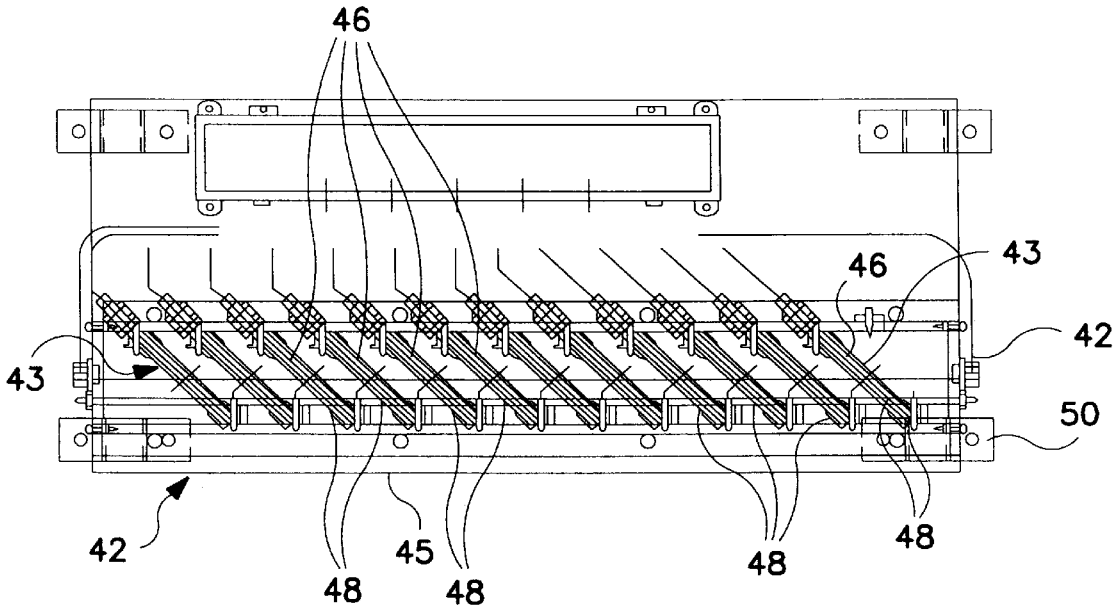
FIG. 6 is a plan view of a tension regulator portion of the apparatus illustrated in FIG. 1.

The ribbon strands 14 exiting from the remote ends of the curl tubes are advanced into the tension regulator unit 42 which serves to maintain sufficient tension on the ribbon to overcome the tendency of the ribbon to curl imparted by the curl tubes 30. To this end, as shown in FIG. 6, each ribbon strand is directed into a separate tension path 43. In the present instance, each tension path is disposed at an angle of 45° to the longitudinal axis of the tension regulator unit 42. The tension path 43 is defined by an elevated entry guide 46, an elevated exit guide 48 and a weight roller therebetween. The strand is guided over the entrance guide 46 under the roller and over the exit guide 48 and then is allowed to advance longitudinally of the unit 42 to the exit end 50 at the righthand end of the tension unit frame 45. The weight roller suspended on the loop of the stand between the entrance guide 46 and exit guide 48 maintain sufficient tension on the strand to overcome its tendency to curl, avoiding tangles of the strands in the tension regulator unit 42.

As shown in FIG. 1, each strand 14 is directed from its associated curling tube to a tension path 43 in the unit 42. As a strand 14 is paid out through the feed rolls 22, it travels into the tension regulator unit 43 where its tension is maintained by the weight of the roller. The height of the guides 46 and 48 above the floor of the unit 42 is sufficient to allow an accumulation of a length of approximately twice the height of the unit within each tension path 43 of the tension regulator unit. In order to meter the desired accumulation of the individual strands in the unit 42, the weight roller is coupled to a sensor unit which senses the vertical position of the weight roller between the guides 46 and 48. The sensor, in turn, is coupled to the control circuit 24 for the feed rollers controlling the feed of the strand to that particular tension path so that when the weight is raised by the discharge of the strand to the exit end 50 from the tension path 43, the feed rollers for that strand will be activated when the weight roller reaches an upper limit position 55 (see FIG. 1). Activating the feed rollers 22 for that strand will cause an additional length of strand to be paid out into the tension path 43 from the associated curl tube 30, thereby causing the weight roller to fall to accommodate the longer length of ribbon between the entry and exit guides 46 and 48. When the accumulation of the ribbon strand in the tension path 43 is sufficient, the weight roller drops to its lower limit position 57 and the sensor associated with the weight roller signals the controller 24 to arrest the advance of the feed rollers 22. Thus, the tension regulator unit 42 meters the accumulation of a sufficient length of each strand within the unit 42 at all times.

The angular orientation of the tension path 43 in the unit enables the plurality, in the present instance twelve strands 14 to be fed to the entry guides 46 in spaced parallel array, as shown in FIG. 1. The strands exiting the tension path 43 at the exit guides 48 are advanced from the exit end of the tension regulator unit and are stacked one upon the other in face-to-face confronting relation in a stacker shown diagrammatically at 51 in the packaging unit 65.

In the illustrated embodiment, a single stacker is shown diagrammatically at 51 which will stack all twelve ribbons to form a twelve-layer stack. However, additional stackers may be added to form plural stacks of less than twelve strands. The stacker 51 is at the entrance end of the packaging unit 65 and includes a clamp to immobilize the stack with the leading ends of the ribbon strands projecting into the packaging unit.

Figure 7:
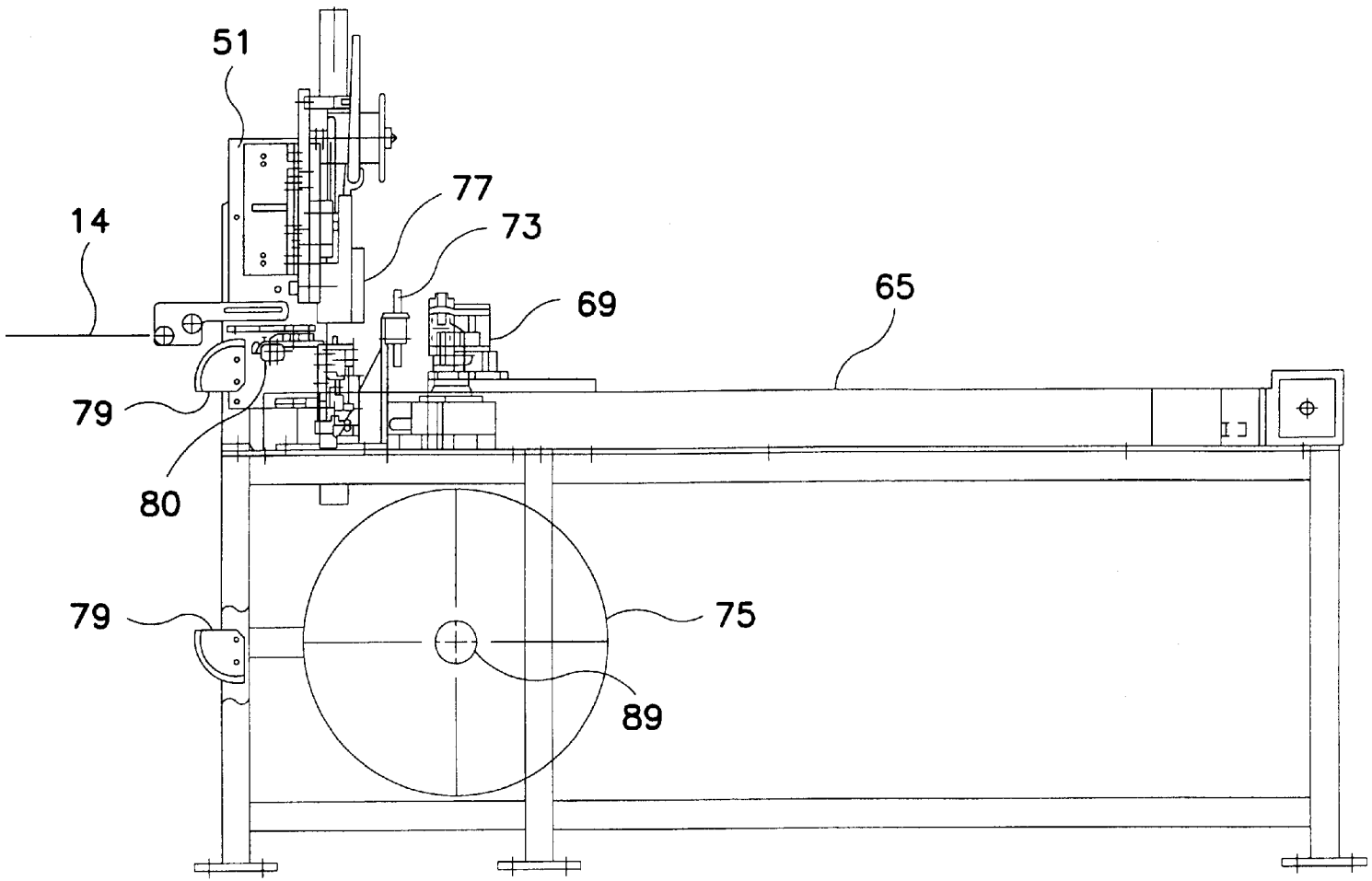
FIG. 7 is an enlarged side view of the packaging unit of the apparatus illustrated in FIG. 1.

The packaging unit 65 operates to withdraw a first part of a predetermined length of the stacked ribbons from the stacking unit 51, attach a placard to the stack of ribbon strands in the middle of the predetermined length, and then to withdraw the remaining part of the predetermined length of the stack and release the same to allow the ribbon strands in the stack to curl up and form a decorative element. To this end, as shown in FIG. 7, the packaging unit has a roll of placard material 75 journaled for rotation on a spindle 89 in the lower part of the unit 65. The placard material is guided at 79, 79 from the roll 75 into a placard feed mechanism 80 associated with a stapler 77 having an anvil for attaching a placard to the stack. The stack of ribbon strands 14 is fed past the anvil of the stapler 77 over the placard material fed thereto, and the stacker 51 clamps the stack in place with the free leading end of the stack of exposed.

A gripper arm 69 is provided to grip the free end of the stack of ribbon strands and to withdraw the stack of strands past the anvil through the mouth of the stapler. The gripper arm 69 is designed to withdraw a predetermined length of the stacked ribbon strands past the anvil of the stapler 77 and the operation is accomplished in two stages. In the first stage, the gripper withdraws approximately one half of the predetermined length of the stacked ribbons past the anvil of the stapler and is arrested while the stapler 77 is actuated to attach the ribbons to the placard which has previously been fed to the stapler. The clamp of the stacker 51 is operated in timed relation to the gripper arm 69 to release the stack when the gripper withdraws the stack from the stapler 77. After the stapling operation, the gripper 69 withdraws the remainder of the predetermined length past the stapler anvil, and a cutter mechanism 73 operates to separate the predetermined length of stacked ribbons from the continuous length of ribbons projecting from the stacker. Prior to the severing, the predetermined length of stacked strands extends from the stapler 77 to the withdrawn gripper 69 at the righthand end of the packaging unit. When the predetermined length is severed, the gripper 69 releases its grip on the stacked strands and the individual strands in the stack stapled to the placard are then free to curl upon themselves and form a decorative element stapled to the placard.

The longitudinal displacement or throw of the gripper 69 corresponds to the predetermined length of the strands in the decorative element formed in the packaging unit, which in turn correspond to the metered length strands accumulated in the tension regulator 42. When the gripper releases its grip on the strands concurrently with the severing of the opposite end of the stack, the placard with the ribbons attached may drop onto a conveyor for incorporation in packaging for the consumer.

Although a single embodiment has been described and illustrated in this application, it is not intended to limit the invention as disclosed, but changes and modifications may be made therein and thereto within the scope of the following claims.

What is claimed is:

1. A method for curling a ribbon for attachment to a placard to create a decorative element, comprising the steps of:

supplying at least one strand of ribbon having a flat face;

providing a curling apparatus having a curling tube with a circumferential generally cylindrical exterior defining a helical ribbon path therearound, said path having a first part and a second part;

directing the ribbon strand in said helical ribbon path with said flat face wrapped around the exterior of the curling tube, and heat-treating said ribbon strand by heating said ribbon strand in the first part of the path and cooling said ribbon strand in the second part of the path, said heating and cooling of said ribbon while wrapped around said tube imparting to the heat-treated ribbon a tendency to curl.

2. A method of curling a ribbon according to claim 1 wherein said path is defined by providing a helical groove around the exterior of said tube, and said heat treating is effected by directing temperature-controlled air into said groove.

3. A method of curling a ribbon according to claim 2 wherein said curling tube is hollow with discharge apertures in registry with said helical groove, and said temperature-controlled air flows through said hollow tube and out through said discharge apertures, heating air being discharged through apertures in registry with the first part of said path, and cooling air being discharged through apertures in registry with the second part of said path.

4. A method of curling a ribbon according to claim 3 including the step of providing a helical fin around said cylindrical surface to define the helical groove, said apertures operable to discharge the temperature-controlled air into said groove.

* * * * *